US009920542B1

(12) United States Patent
Koetter

(10) Patent No.: US 9,920,542 B1
(45) Date of Patent: Mar. 20, 2018

(54) TRUSS SETTING BRACKET AND METHOD FOR USE

(71) Applicant: Raymond E. Koetter, Floyds Knobs, IN (US)

(72) Inventor: Raymond E. Koetter, Floyds Knobs, IN (US)

( * ) Notice: Subject to any disclaimer, the term of this patent is extended or adjusted under 35 U.S.C. 154(b) by 0 days.

(21) Appl. No.: 15/830,774

(22) Filed: Dec. 4, 2017

Related U.S. Application Data

(63) Continuation-in-part of application No. 15/384,015, filed on Dec. 19, 2016, now Pat. No. 9,856,663.

(51) Int. Cl.

| | |
|---|---|
| ***E04G 21/18*** | (2006.01) |
| ***E04G 21/16*** | (2006.01) |
| ***E04G 21/26*** | (2006.01) |
| ***B25B 5/04*** | (2006.01) |
| ***B25B 5/12*** | (2006.01) |
| ***B25B 5/16*** | (2006.01) |
| *E04C 3/02* | (2006.01) |
| *E04B 7/02* | (2006.01) |

(52) U.S. Cl.
CPC ..... *E04G 21/1883* (2013.01); *B25B 5/04* (2013.01); *B25B 5/127* (2013.01); *B25B 5/163* (2013.01); *E04G 21/16* (2013.01); *E04G 21/1891* (2013.01); *E04G 21/26* (2013.01); *E04B 7/022* (2013.01); *E04C 2003/026* (2013.01); *Y10S 269/904* (2013.01); *Y10S 269/91* (2013.01)

(58) Field of Classification Search
CPC ..... B25B 5/068; B25B 5/163; B25B 5/04; B25B 5/102; B25B 5/085; B25B 5/06; B25B 5/14; B25B 5/16; B25B 5/003; B25B 5/006; B25B 5/127; E04G 21/1891; E04G 21/16; E04G 21/1841; E04G 21/26; Y10S 269/91; Y10S 269/904; Y10S 269/90; Y10S 269/909
USPC ..... 52/643, 739.1, 127.2, 745.06; 33/613, 33/645; 269/37, 910, 6, 3, 166
See application file for complete search history.

(56) References Cited

U.S. PATENT DOCUMENTS

| | | | | |
|---|---|---|---|---|
| 3,765,543 A * | 10/1973 | Thomas | E04G 21/16 | 294/74 |
| 4,704,829 A * | 11/1987 | Baumker, Jr. | E04B 7/022 | 269/43 |
| 5,148,605 A * | 9/1992 | Julia | E04G 17/12 | 269/236 |
| 7,254,920 B2 * | 8/2007 | Steele | E04F 21/185 | 33/371 |

(Continued)

*Primary Examiner* — Joshua J Michener
*Assistant Examiner* — Matthew J Gitlin
(74) *Attorney, Agent, or Firm* — Middleton Reutlinger; Robert H. Eichenberger

(57) ABSTRACT

A truss setting bracket and a method relating to setting a truss using the truss setting bracket are disclosed herein. In some embodiments, the truss setting bracket includes an elongated body member having a first cradle, a second cradle, an elongated catch guide, and a locking arm. In other embodiments, the truss setting bracket includes an elongated body member having a first cradle, a bracket, an elongated catch guide, and a locking arm. In yet other embodiments, the method of setting the truss may include sliding the truss setting bracket over a member of a first truss, lifting the first truss towards a second truss, and removably locking the truss setting bracket to a member of the second truss.

20 Claims, 11 Drawing Sheets

(56) References Cited

U.S. PATENT DOCUMENTS

| | | | | |
|---|---|---|---|---|
| 7,273,210 | B2 * | 9/2007 | Thurston | B25B 5/006 269/254 CS |
| 7,377,048 | B2 * | 5/2008 | Koetter | E04B 7/022 269/37 |
| 8,833,747 | B2 * | 9/2014 | Cusumano | B25B 5/003 269/143 |
| 2009/0146354 | A1 * | 6/2009 | Metroyanis | E04G 21/1891 269/43 |
| 2016/0024791 | A1 * | 1/2016 | Reno | E04C 3/02 52/745.21 |
| 2017/0209985 | A1 * | 7/2017 | Burnard | B25B 5/003 |

* cited by examiner

TRUSS SETTING BRACKET AND METHOD FOR USE

CROSS-REFERENCE TO RELATED APPLICATIONS

The present application claims priority to and is a continuation-in-part under 35 U.S.C. § 120 of U.S. patent application Ser. No. 15/384,015 filed Dec. 19, 2016 and entitled "Truss Setting Bracket and Method for Use." The aforementioned patent application is hereby incorporated by reference.

TECHNICAL FIELD

Generally, a truss setting bracket is taught. Additionally, a method for setting a truss using the truss setting bracket is taught.

BACKGROUND

In construction, after a foundation for a residential home, a commercial building, etc. has been completed, a framing stage may begin. The framing stage includes setting additional support structures atop the walls, including a plurality of trusses. Together the walls and trusses provide a skeletal structure for the residential home, commercial building, etc. The plurality of trusses are conventionally comprised of, but not limited to, wood and/or steel. Commonly, the plurality of trusses are assembled at a different location, or pre-fabricated, and then shipped to the construction location to be lifted and guided into place by construction workers.

Setting each of the plurality of trusses is a time-consuming, tedious process that involves several construction workers coordinating with one another to lift each of the plurality of trusses from the ground and guide each of the plurality of trusses to a desired location on a wall or support, which may be a dangerous task. This usually requires several construction workers on the ground to secure the truss to a crane, several more construction workers on the wall or roof to guide and secure each successive truss to the wall or roof, and at least one construction worker operating the crane to lift each truss from the ground to the roof. Additionally, the crane is often rented by the construction company on an hour-by-hour basis. Therefore, the overall cost of a construction project is directly proportional to the time spent setting each of the plurality of trusses. This process of lifting, guiding, and securing each of the plurality of trusses without any additional aide raises the already high cost of construction and can be hazardous.

Moreover, safety may be the largest priority of any construction project. Construction workers on the wall or roof that guide and secure the truss to the wall or support and the at least one construction worker operating the crane face significant safety hazards. Minimizing the number of construction workers exposed to these safety hazards should minimize the amount of construction-related accidents.

A truss setting bracket is presented in commonly-owned U.S. Pat. No. 7,377,048. Such bracket facilitates setting trusses, but can be improved.

There is a need in the art for further facilitating the safe and easy setting of trusses.

SUMMARY

Generally, in one aspect, a truss setting bracket is presented that may include an elongated body member having a first end, a second end, and an axis of elongation. A first cradle may be connected to the first end of the elongated body member and may include a first finger and a second finger. The first finger and the second finger of the first cradle create a first cradle surface disposed therebetween. A second cradle may be connected to the second end of the elongated body member and may include a first finger and a second finger. The first finger and the second finger of the second cradle create a second cradle surface disposed therebetween. An elongated catch guide may be connected to a finger, such as the first finger of the second cradle, and may be pivotable between at least a first position and a second position. A locking arm may be connected to a finger, such as the second finger of the second cradle, and may removably retains a member of a truss.

In some embodiments, the truss setting bracket may further include an aperture disposed on at least one of the first finger or the second finger of the first cradle. In some embodiments, the truss setting bracket may even further include an elongated body recess. If included, each of the first cradle and the second cradle may be retainable within the elongated body recess. In some embodiments, the first cradle and the second cradle may be slidable along the axis of elongation.

In some embodiments, the truss setting bracket may further include markings indicating interval measurements. In some embodiments, each of the first cradle and the second cradle may have a locking mechanism for releasably locking each of the first cradle and the second cradle at multiple locations along the axis of elongation. In some embodiments, the truss setting bracket may include physical recesses or stop locations disposed at predetermined locations. In some embodiments, each of the first cradle surface and the second cradle surface may be substantially U-shaped and may be defined by a first surface generally perpendicular to the elongated body member, a second surface generally perpendicular to the elongated body member, and a third surface generally parallel to the elongated body member.

In some embodiments, the elongated catch guide in the first position may be substantially parallel to the elongated body member and in the second position may be substantially perpendicular to the elongated body member. In other embodiments, the truss setting bracket may further include a first foot disposed towards a terminal end of the first finger of the second cradle and a second foot disposed towards a terminal end of the second finger of the second cradle. If included, the second foot may further include a coupling mechanism to removably retain the elongated catch guide in the second position. If included, the elongated catch guide may connect to the coupling mechanism of the second foot by a locking mechanism. If included, the locking mechanism may be removable, such that in the second position the elongated catch guide is removably retained by the coupling mechanism of the second foot.

In some embodiments, the locking arm may be connected to the second finger of the second cradle by a removable locking mechanism. If included, the locking arm may be pivotable between at least a first position and a second position. If included, in the first position the locking arm may removably retain the portion of the truss and in the second position the locking arm may release the portion of the truss.

Generally, in yet another aspect, a truss setting bracket is presented that may include an elongated body member having a first end, a second end, an axis of elongation, and an elongated body recess. A first cradle may be connected to the first end of the elongated body member and may include a first finger and a second finger. The first finger and the second finger of the first cradle create a first cradle surface disposed therebetween. Additionally, the second finger of the first cradle may include an aperture therein that aides in removably retaining a member of a truss. A second cradle may be connected to the second end of the elongated body member and may include a first finger and a second finger. The first finger and the second finger of the second cradle create a second cradle surface disposed therebetween. Each of the first cradle and the second cradle are slidable along the axis of elongation and retainable within the elongated body recess. An elongated catch guide may be connected to the first finger of the second cradle and may be pivotable between at least a first position and a second position. A locking arm may be connected to the second finger of the second cradle and may removably retain the member of the truss.

Generally, in yet another aspect, a method for setting a truss is provided. The method includes providing a truss setting bracket having a first cradle, a second cradle, an elongated catch guide, and a locking arm. The method may further include sliding the first cradle of the truss setting bracket over a member of a first truss. The first cradle of the truss setting bracket is secured to the member of the first truss through an aperture. The elongated catch guide of the truss setting bracket is pivoted from a first position to a second position. The first truss is lifted towards a second truss. The elongated catch guide of the truss setting bracket, attached to the member of the first truss, is guided into engagement with a member of the second truss, such that the second cradle of the truss setting bracket slides over the member of the second truss. The truss setting bracket is secured onto the member of the second truss, such that the locking arm of the truss setting bracket removably retains the truss setting bracket on the second truss.

In some embodiments, the method may further include the steps of installing a plurality of structural support members and removing the truss setting bracket.

Generally, in one aspect, a truss setting bracket is presented that may include an elongated body member having a first end, a second end, a first side, a second side, and an axis of elongation. A first cradle may be located at the first end of the elongated body member and depend downwardly from the second side. The first cradle may include a first finger and a second finger. The first finger and the second finger of the first cradle create a first cradle surface disposed therebetween. A brace may be located at the second end of the elongated body member and depend downwardly from the second side. The brace may include a leg and a first ramp depending therefrom. The first ramp may be located between the first cradle and the leg. The leg may include a second ramp at a terminal end thereof and a leg surface. An elongated catch guide may be pivotally connected the first ramp for guiding the truss setting bracket toward a member of a truss, and may be pivotable between at least a first position and a second position. A locking arm may be connected to the leg, and may removably retain a member of a truss.

In some embodiments, the truss setting bracket may further include an aperture disposed on at least one finger of the first cradle, such as the first finger or the second finger. The truss setting bracket may further include an elongated body recess disposed parallel to the axis of elongation. If included, the first cradle and the brace may be retainable within the elongated body recess. The first cradle and the brace may be slidable along the axis of elongation. Each of the first cradle and the brace may have a locking mechanism for releasably locking each of the first cradle and the brace at multiple locations along the axis of elongation. The elongated body member may further include markings indicating interval measurements along the elongated body member.

In some embodiments, the elongated catch guide may be substantially parallel to the elongated body member in the first position, and may be substantially perpendicular to the elongated body member in the second position. In the second position, the elongated catch guide and the leg surface may create a channel for receiving a portion of the member of the truss. Further, in the second position, the first cradle surface and the channel may be substantially U-shaped. Even further, the first cradle surface may be defined by a first surface generally perpendicular to the elongated body member, a second surface generally perpendicular to the elongated body member, and a third surface generally parallel to the elongated body member.

In some embodiments, the locking arm may be connected to the leg by a removable locking mechanism. In these embodiments, the locking arm may be pivotable between at least a first position and a second position. In the first position, the locking arm removably may retain the portion of the member of the truss, and in the second position, the locking arm may release the portion of the member of the truss.

In some embodiments, the first ramp may include a coupling mechanism and the elongated catch guide may include a locking mechanism. If included, when the elongated catch guide is in the second position, the locking mechanism of the elongated catch guide may be removably retained by the coupling mechanism of the first ramp.

Generally, in another aspect, a truss setting bracket is presented that may include an elongated body member having a first end, a second end, a first side, and a second side. The first end may include a first cradle depending downwardly from the second side. The first cradle may be slidable over a member of a first truss. The second end may include a brace depending downwardly from the second side, an elongated catch guide, and a locking arm. The brace may include a leg and a first ramp depending therefrom. The leg may further include a second ramp at a terminal end thereof and may include a leg surface. The elongated catch guide may be pivotally connected to the first ramp for guiding the truss setting bracket toward a member of a second truss. The elongated catch guide may be pivotable between at least a first position and a second position. The locking arm may be connected to the leg and removably retain the member of the second truss.

In some embodiments, when the elongated catch guide is in the second position, the elongated catch guide and the leg surface may create a channel for receiving the member of the second truss.

Generally, in yet another aspect, a method for setting a truss is provided. The method includes providing a truss setting bracket having a first cradle, a brace, an elongated catch guide, and a locking arm. The method may further include sliding the first cradle of the truss setting bracket over a member of a first truss. The first cradle of the truss setting bracket is secured to the member of the first truss through an aperture. The elongated catch guide of the truss setting bracket is pivoted from a first position to a second position. The first truss is lifted towards a second truss. The elongated catch guide of the truss setting bracket is guided into contact with a member of the second truss, such that the brace of the truss setting bracket receives the member of the second truss. The truss setting bracket is secured onto the member of the second truss, via the locking arm, such that the locking arm of the truss setting bracket removably retains the truss setting bracket on the second truss.

In some embodiments, the method may further include the steps of installing a plurality of structural support members and removing the truss setting bracket.

It should be appreciated that all combinations of the foregoing concepts and additional concepts discussed in greater detail below provided such concepts are not mutually inconsistent are contemplated as being part of the subject matter disclosed herein. In particular, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, emphasis instead being generally placed upon illustrating the principles of the embodiments depicted.

DETAILED DESCRIPTION

Figure 1:
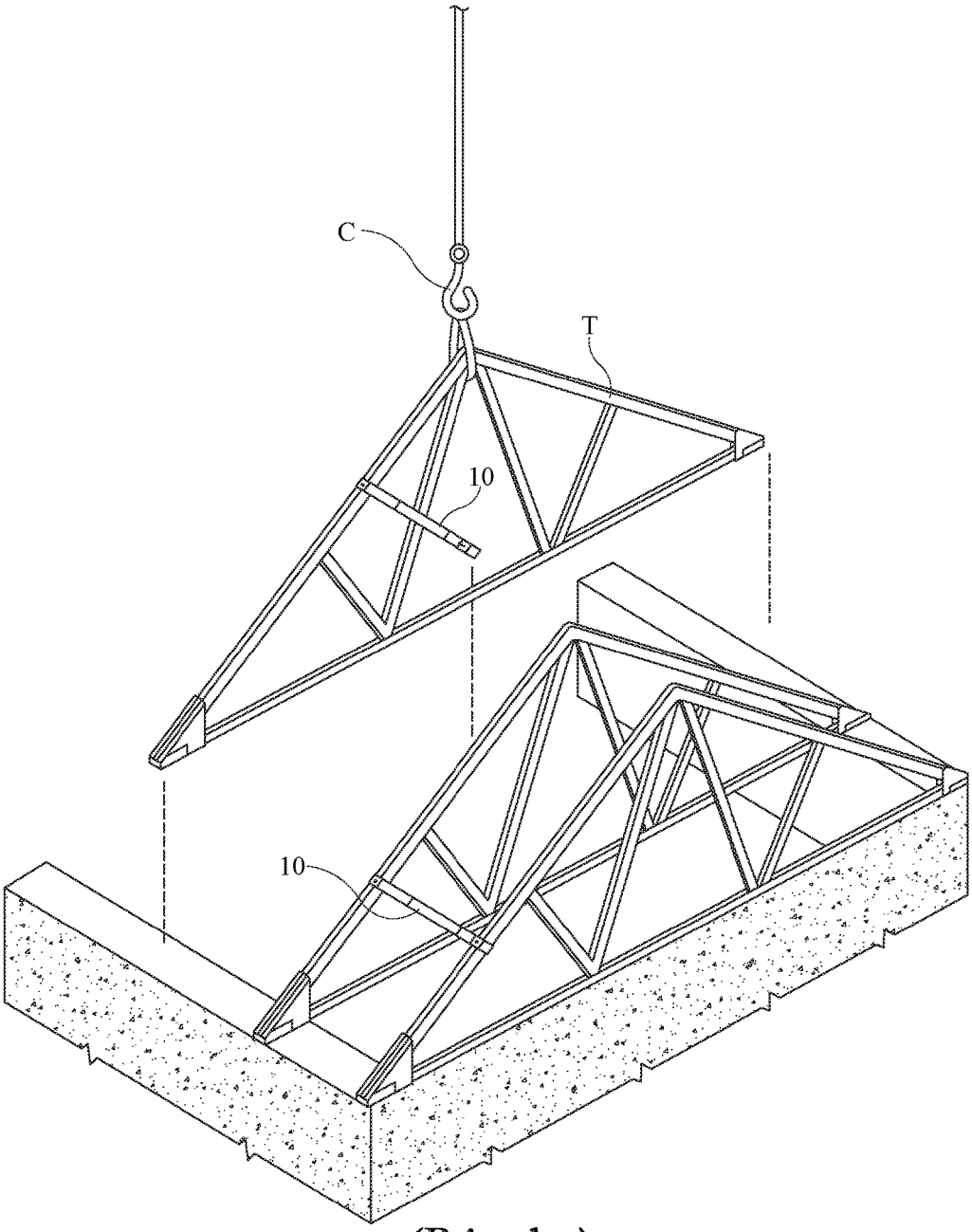
(Prior Art) FIG. 1
FIG. 1 is an environmental, perspective view of a known truss setting bracket.

It is to be understood that the embodiments are not limited in their application to the details of construction and the arrangement of components set forth in the following description or illustrated in the drawings. Other embodiments are possible and may be practiced or carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected" and "coupled" and variations thereof herein are used broadly and encompass direct and indirect connections and couplings. In addition, the terms "connected" and "coupled" and variations thereof are not restricted to physical or mechanical connections or couplings.

Referring initially to FIG. 1, an environmental, perspective view of a known truss setting bracket according to commonly-owned U.S. Pat. No. 7,377,048 is provided. The known truss setting bracket is secured to a member of a first truss. The first truss is then lifted by a crane and guided towards a second truss, such that the spacing between the first truss and the second truss is approximately the width of the truss setting bracket.

With reference to FIGS. 2-8, a truss setting bracket 10 is generally shown. The truss setting bracket 10 may include an elongated body member 12, a first cradle 20, a second cradle 30, an elongated catch guide 50, and a locking arm 60. In some embodiments, the elongated body member 12 may include a first end 14, a second end 16, a first side 15, a second side 17, an axis of elongation A-A, and an elongated body recess 18. In some embodiments, each of the first cradle 20 and the second cradle 30 may be retainable within the elongated body recess 18 and may be slidable along the axis of elongation A-A.

In some embodiments, the first cradle 20 may include a first finger 21 and a second finger 22, which may create a first cradle surface 24 disposed between the first finger 21 and the second finger 22. In some embodiments, the second cradle 30 may include a first finger 31 and a second finger 32, which may create a second cradle surface 34 disposed between the first finger 31 and the second finger 32. In some embodiments, each of the first cradle 20 and the second cradle 30 may include a locking mechanism 25, 35, respectively, along the axis of elongation A-A. This may allow adjustment of the distance between the first cradle 20 and the second cradle 30 to achieve a desired spacing between successive trusses. The first cradle surface 24 may removably retain a member of a first truss T1 by an aperture 40 and the second cradle surface 34 may removably retain a member of a second truss T2 by the locking arm 60.

In some embodiments, the elongated catch guide 50 may be connected to the second cradle 30 and pivotable between at least a first position and a second position and the locking arm 60 may also be connected to the second cradle 30. The locking arm 60 may further include a spring mechanism 62 that enables the locking arm 60 to move between a first position and a second position.

The method for using the truss setting bracket 10 may begin with the step of sliding the first cradle 20 of the truss setting bracket 10 over the member of the first truss T1. The first cradle 20 may be secured to the member of the first truss through the aperture 40 using various types of removable securing devices, for example nails. The elongated catch guide 50 may be pivoted from the first position to the second position and connected to the second cradle 30 by a coupling mechanism 51. The first truss T1 may be lifted by a crane C towards the member of the second truss T2 and guided by at least one construction worker using the elongated catch guide 50. The construction worker may guide the first truss T1, such that the elongated catch guide 50 enables the second cradle 30 to engage at the member of the second truss. The second cradle 30 may removably retain, automatically or manually, the member of the second truss by the locking arm 60.

An exemplary truss setting bracket 10 and an exemplary method for using the truss setting bracket 10 are depicted in FIGS. 2-8. However, FIGS. 2-8 are for exemplary purposes only and are not meant to be limiting. The exemplary truss setting bracket 10 and exemplary method for using the exemplary truss setting bracket 10 is depicted and described as utilizing one truss setting bracket, but this is for the sake of brevity and not meant to be limiting. In some embodiments, a plurality of truss setting brackets may be used to set one truss. The number of truss setting brackets utilized may vary based on the size of the truss being set, the number of construction workers setting the truss, and/or the number of safety risks that may be mitigated by using the plurality of truss setting brackets. Additionally, the exemplary truss setting bracket 10 may be re-used for setting a plurality of successive trusses, until a framing stage of construction is complete. Once the framing stage of construction is completed, the exemplary truss setting bracket 10 may be utilized in subsequent construction projects.

Figure 2:
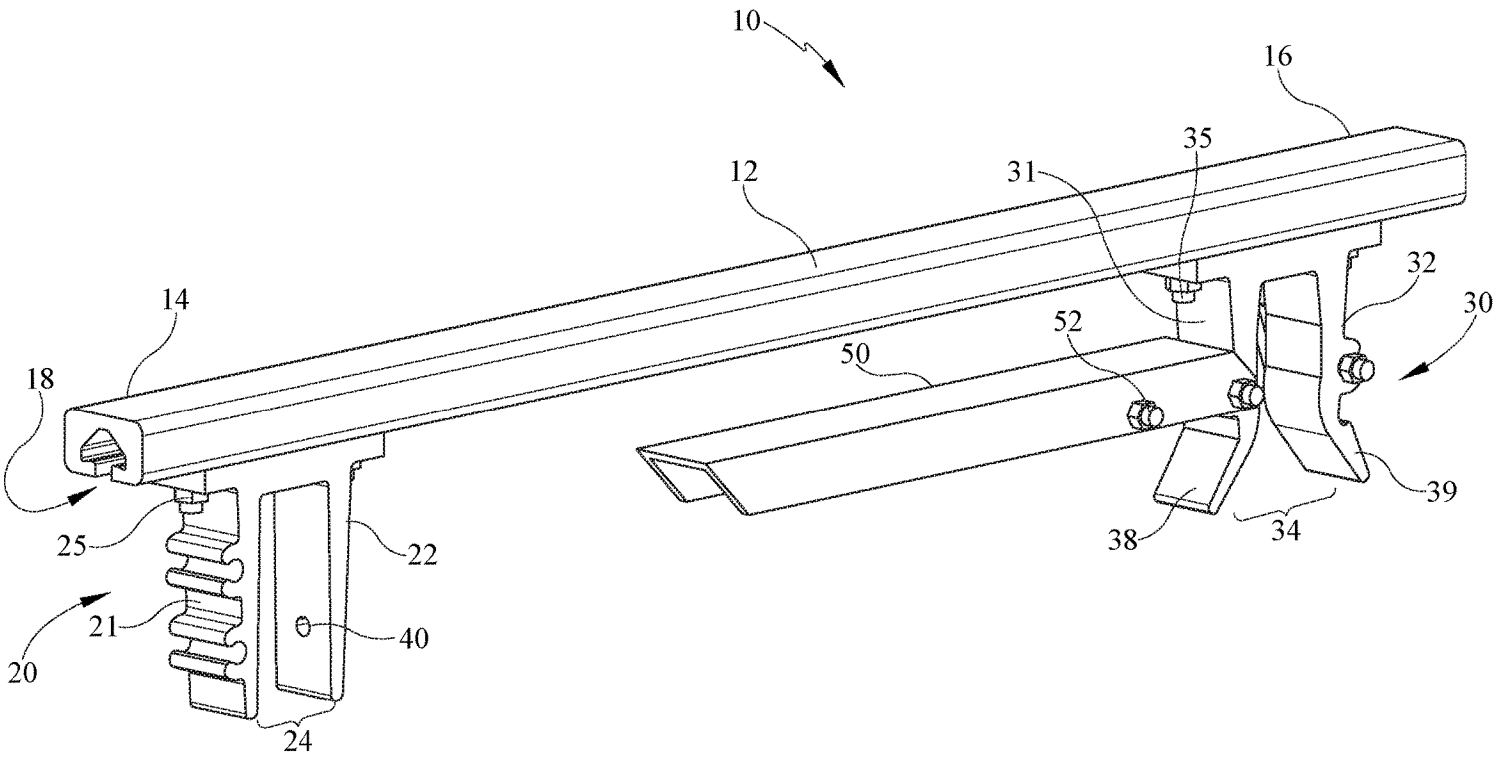
FIG. 2 is a perspective view of an exemplary truss setting bracket according to one embodiment herein.

Referring now to FIG. 2, a perspective view of an exemplary truss setting bracket 10 is depicted having an elongated body member 12, a first cradle 20, a second cradle 30, an aperture 40, and an elongated catch guide 50. The elongated body member 12 is defined in part by a first end 14 (FIG. 3), a second end 16 (FIG. 4, FIG. 5, and FIG. 6), an elongated body recess 18, and an axis of elongation A-A. The elongated body member 12 may take on various lengths depending on a desired spacing between successive trusses. Generally speaking, the elongated body member 12 can be in the range of approximately one foot long to approximately ten feet long, but most preferably would be in the range of approximately two feet long to four feet long.

The first cradle 20 and the second cradle 30 are retainable within the elongated body recess 18 by a locking mechanism 25, 35, respectively, and slidable along the access of elongation A-A. Markings indicating interval measurements may be disposed proximate the first cradle 20 and the second cradle 30, such that the distance between the first cradle 20 and the second cradle 30 may be adjusted. If, for example, the elongated body member 12 is three feet long, then the distance between the first cradle 20 and the second cradle 30 may be adjusted to two feet to achieve a two foot spacing by sliding each of the first cradle 20 and the second cradle 30 within the elongated body recess 18. For example, if the desired spacing between successive trusses is five feet, then the truss setting bracket 10 may have an elongated body member 12 that is, for example, six feet long and each of the first cradle 20 and the second cradle 30 may be located approximately six inches toward the center of the elongated body member 12 from the first end 14 and the second end 16. Each of the first cradle 20 and the second cradle 30 may then be secured in place using each respective locking mechanism 25, 35.

The first cradle 20 may further include a first finger 21 and a second finger 22. An aperture 40 may be disposed on either the first finger 21, the second finger 22, or both, but is depicted as being disposed on the second finger 22 in FIG. 1. The arrangement of the first finger 21 and the second finger 22 creates a first cradle surface 24 disposed therebetween. The first cradle surface 24 may be substantially U-shaped and may include a first surface 24*a* generally perpendicular to the elongated body member 12, a second surface 24*b* generally perpendicular to the elongated body member 12, and a third surface 24*c* generally parallel to the elongated body member 12 (FIG. 3).

Figure 4:
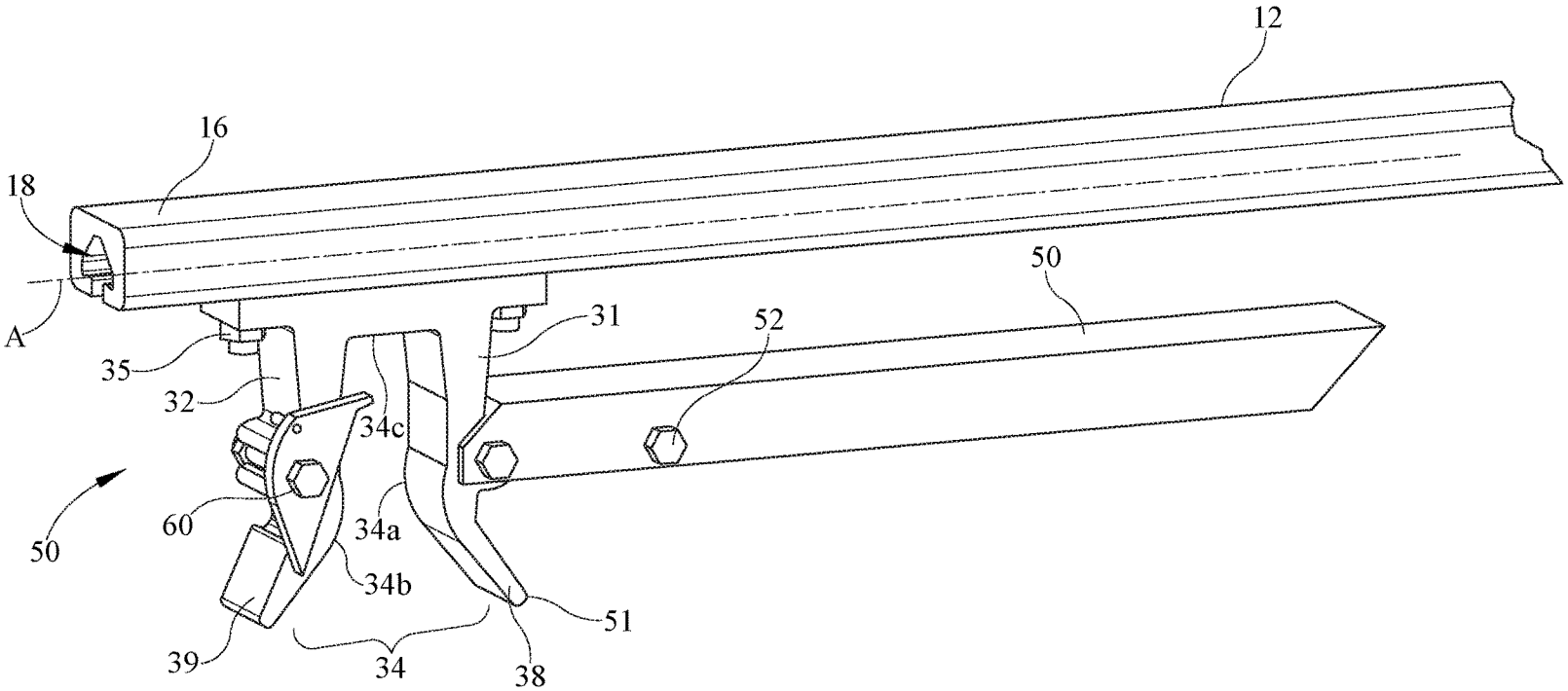
FIG. 4 is a perspective view of a second end of the exemplary truss setting bracket in FIG. 2.

The second cradle 30 may further include a first finger 31 and a second finger 32. The arrangement of the first finger 31 and the second finger 32 creates a second cradle surface 34 disposed therebetween. Like the first cradle surface 24, the second cradle surface 34 may be substantially U-shaped and may include a first surface 34*a* generally perpendicular to the elongated body member 12, a second surface 34*b* generally perpendicular to the elongated body member 12, and a third surface 34*c* generally parallel to the elongated body member 12 (FIG. 4). The first finger 31 may further include a first foot 38 disposed towards its terminal end and the second finger 32 may further include a second foot 39 disposed towards its terminal end. In FIG. 2, the elongated catch guide 50 is depicted in a first position and may be connected to either the first finger 31, the second finger 32, or both, but is depicted as being connected to the first finger 31. The elongated catch guide 50 may further include a locking mechanism 52 that may be removable. The locking mechanism 52 may be, but is not limited to, a physical item positively retaining the elongated catch guide 50 in the second position. Examples include a pin, a spring loaded mechanism, a rod, a screw, a nut, a bolt, a ramp, a cam, and the like.

Figure 3:
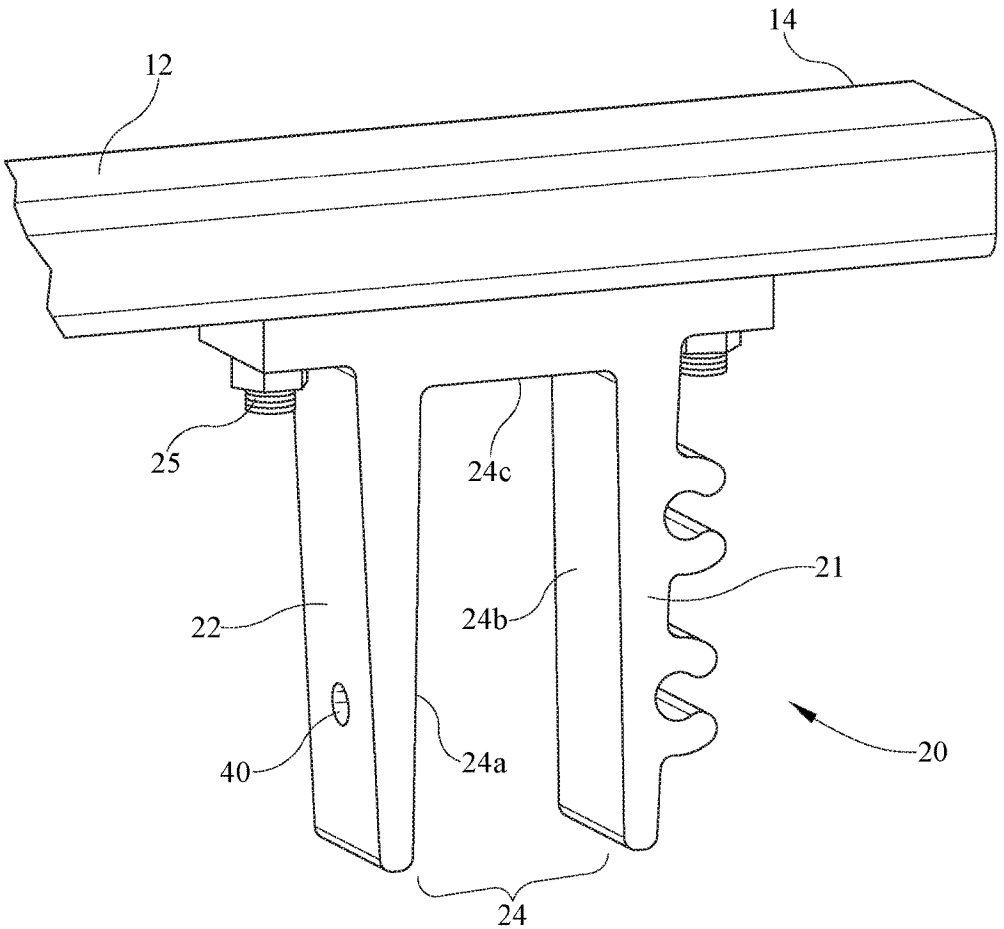
FIG. 3 is a perspective view of a first end of the exemplary truss setting bracket in FIG. 2.

Referring now to FIG. 3, a perspective view of the first end 14 of the elongated body member 12 of the exemplary truss setting bracket 10 is depicted. If the first cradle 20 is at a first desired position along the axis of elongation A-A, then the locking mechanism 25 may be tightened, engaged, etc. If the first cradle 20 is not in at the first desired position along the axis of elongation A-A, then the locking mechanism 25 may be loosened, disengaged, etc. and the first cradle 20 may slide along the axis of elongation A-A within the elongated body recess 18, until the first desired position is achieved. The locking mechanism 25 may be, but is not limited to, a physical item positively retaining the first cradle 20 at the first desired position. Examples include, but are not limited to, a bolt and a nut, a pin, a latch, a screw, a nut, a rod, a spring loaded structure, a ramp, a cam, and the like.

Referring now to FIG. 4, a perspective view of the second end 16 of the elongated body member 12 of the exemplary truss setting bracket 10 is depicted. If the second cradle 30 is at a second desired position along the axis of elongation A-A, then the locking mechanism 35 may be tightened, engaged, etc. If the second cradle 30 is not at the second desired position along the axis of elongation A-A, then the locking mechanism 35 may be loosened, disengaged, etc. and the second cradle 30 may slide along the axis of elongation A-A within the elongated body recess 18, until the second desired position is achieved. The locking mechanism 35 may be, but is not limited to, a physical item positively retaining the second cradle 30 at the second desired position. Examples include, but are not limited to, a bolt and a nut, a pin, a latch, a screw, a nut, a rod, a spring loaded structure, and the like.

In the depicted embodiment of FIG. 4, the elongated catch guide 50 is in the first position and the locking arm 60 is in the second position. This arrangement is favorable for storing the truss setting bracket 10. The first foot 38 may further include a coupling mechanism 51 disposed towards its terminal end and is configured to removably retain the elongated catch guide 50 (FIG. 5) in the second position. The coupling mechanism 51 may be, but is not limited to, a physical structure on the first foot 38. Examples include, a physical perturbation, a rod, and the like.

Figure 5:
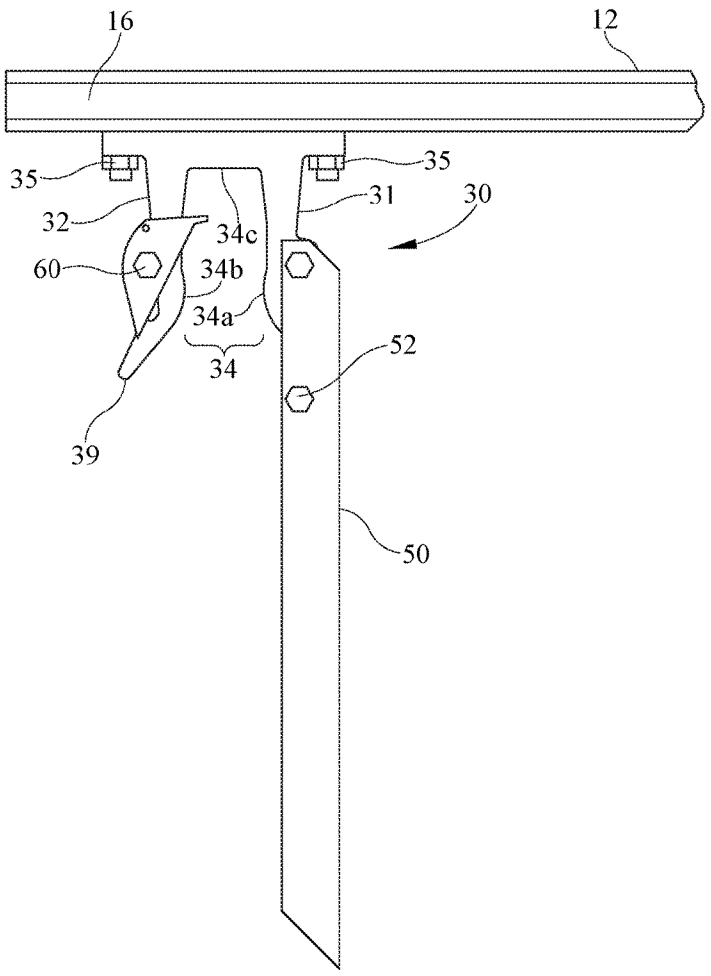
FIG. 5 is a side view of the second end of the exemplary truss setting bracket in FIG. 4.

Referring now to FIG. 5, a side view of the second end 16 of the elongated body member 12 of the exemplary truss setting bracket 10 is depicted. The elongated catch guide 50 is in a second position and removably retained by the coupling mechanism 51. To removably retain the elongated catch guide 50 in the second position, the locking mechanism 52 may be disengaged, the elongated catch guide 50 may be pivoted from the first position to the second position about a rotational axis defined by the first finger 31 and be substantially perpendicular to the elongated body member 12, and the locking mechanism 52 may be engaged about the coupling mechanism 51. The locking arm 60 may be on the second finger 32 of the second cradle 30 and disposed above the second foot 39.

In the second position, the elongated catch guide 50 may aide in maintaining the desired spacing between successive trusses. Once the first truss T1 is lifted and guided towards the member of the second truss T2, the first truss T1 may be lowered towards the second truss T2. The second cradle 30 may slide over the second truss T2 between the first finger 31 and the second finger 32, such that the second truss T2 may be substantially flush with the first surface 34*a*, the second surface 34*b*, and the third surface 34*c* of the second cradle surface 34. In addition to the elongated catch guide 50, the shape of the first foot 38 and the second foot 39 may aide in guiding the truss setting bracket 10 toward the member of the second truss T2 and into the second cradle surface 34. As the first truss T1 is lowered toward the second truss T2 and the attached truss setting bracket 10 is lowered toward the member of to the second truss T2, the locking arm 60 begins to move from the second position to the first position to retain the second truss T2.

Figure 6:
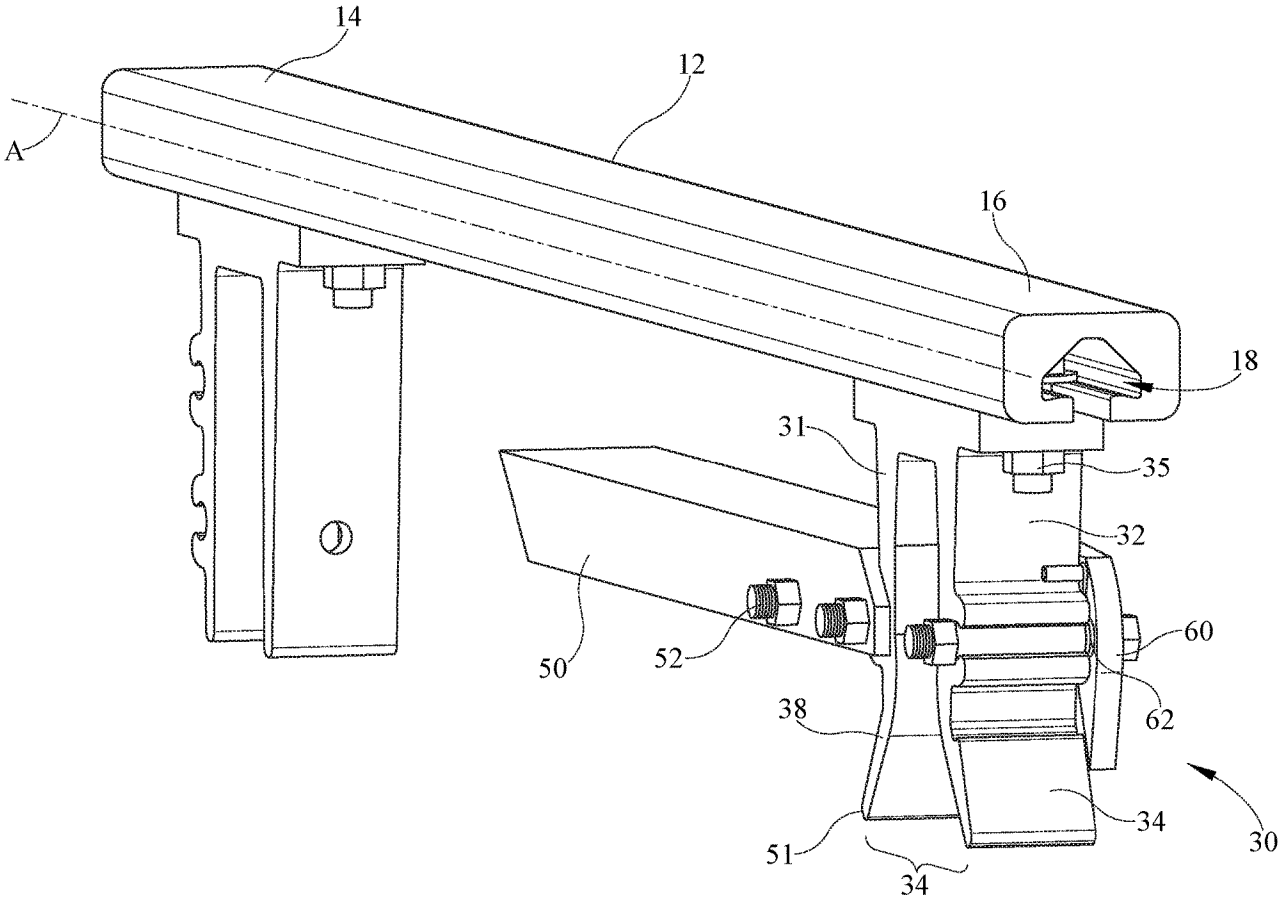
FIG. 6 is a perspective view of the second end of the exemplary truss setting bracket in FIG. 2.

Referring now to FIG. 6, another perspective view of the second end 16 of the elongated body member 12 of the exemplary truss setting bracket 10 is depicted. The locking arm 60 may have a spring mechanism 62 that enables the locking arm 60 to rotate between the second position and the first position upon application of pressure at a distal end of the locking arm 60. A plurality of structural support members may be added to the framing to permanently attach the first truss T1 to the second truss T2, and the truss setting bracket 10 may be removed from the first truss T1 and the second truss T2 by disengaging the aperture 40 to clear the first cradle 20 and the locking arm 60 to clear the second cradle 30. The aperture 40 is disengaged by removing the nail, rope, rod, etc. The locking arm 60 is disengaged by pressing a terminal end of the locking arm 60, such that the locking arm 60 rotates further counter-clockwise. Once the second cradle 30 is cleared, the locking arm 60 may automatically rotate clockwise about the springing mechanism 62 and return to the second position.

Figure 7:
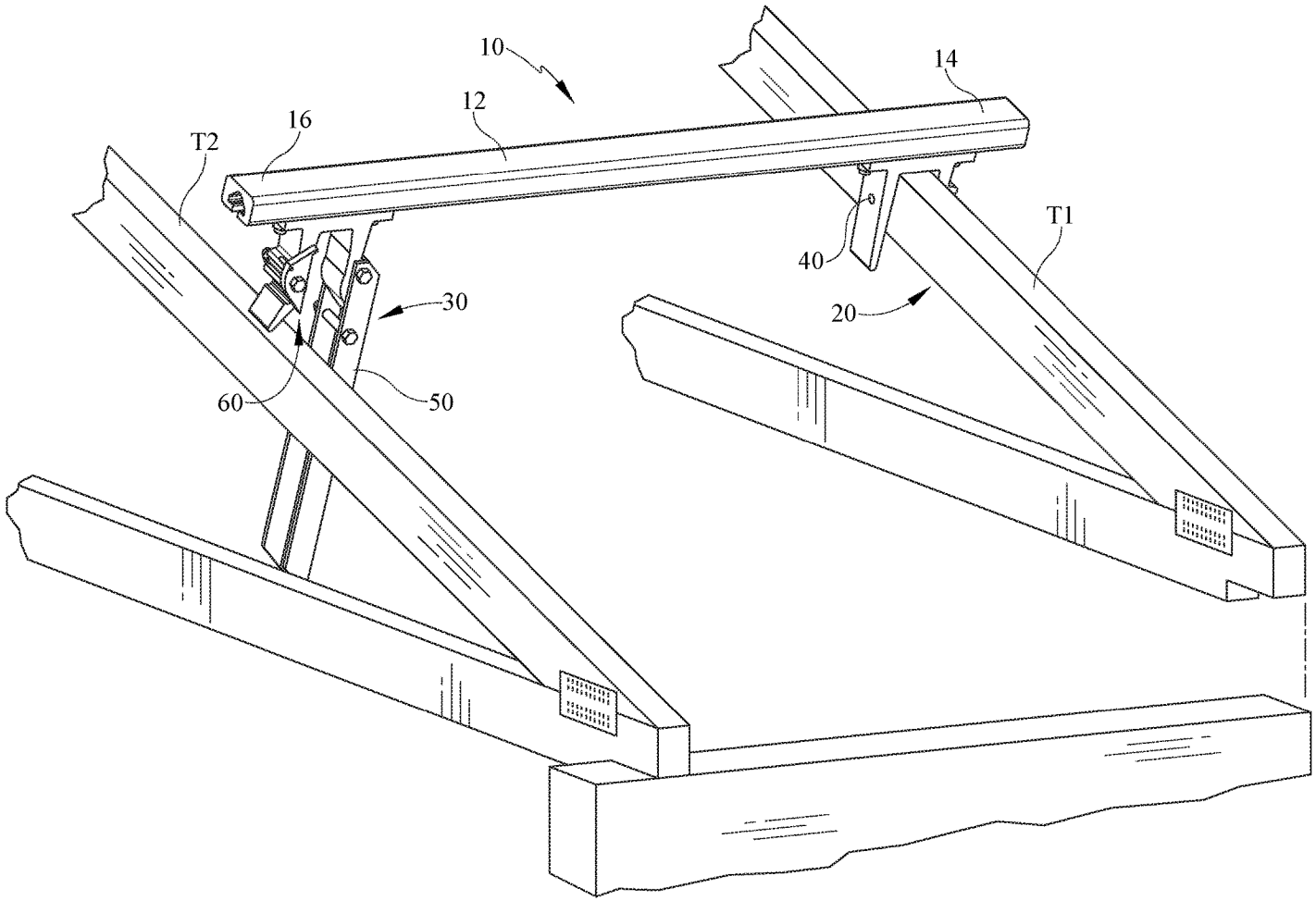
FIG. 7 is an environmental, perspective view of the exemplary truss setting bracket in FIG. 2 being guided to a member of a second truss.
Figure 8:
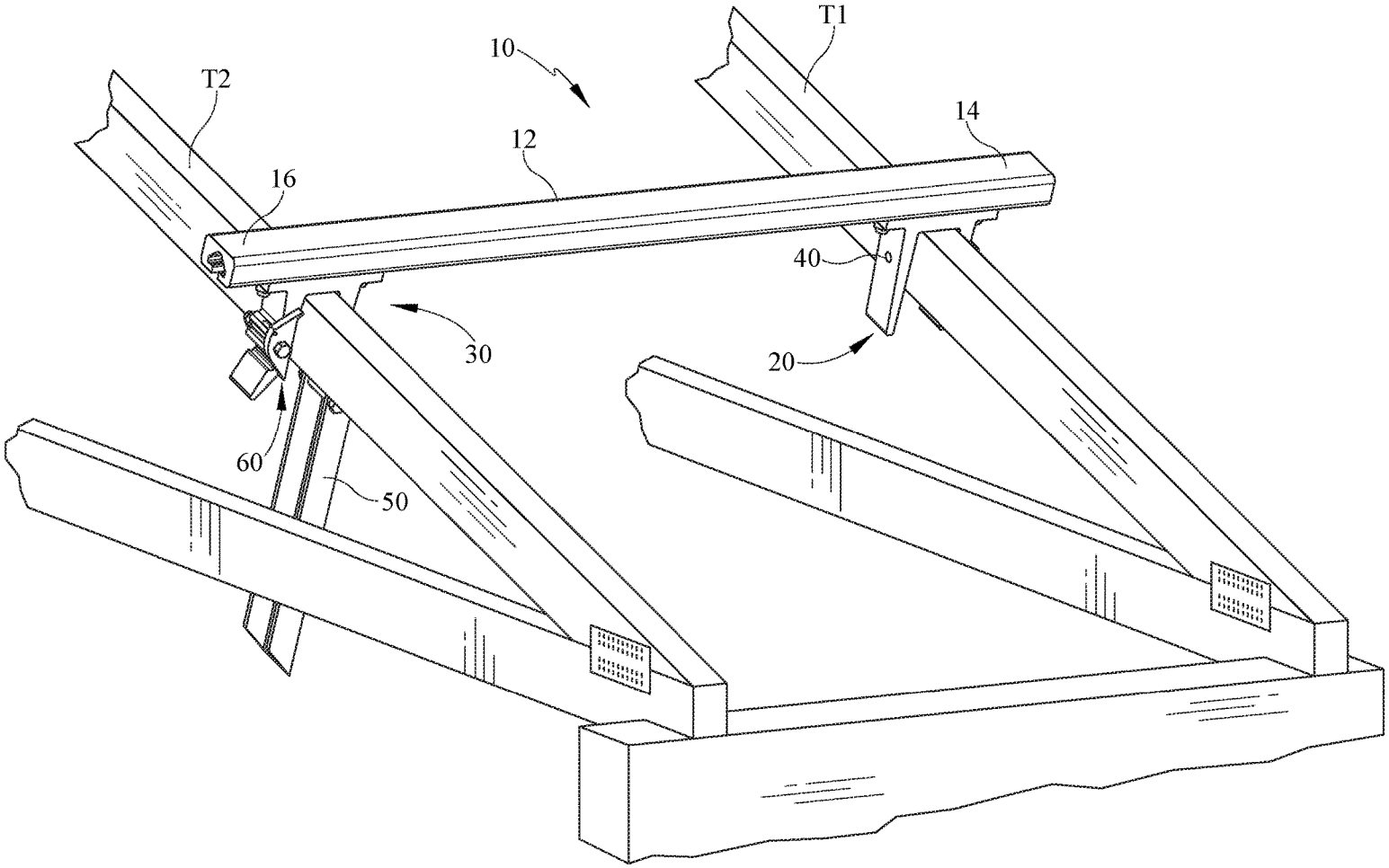
FIG. 8 is an environmental, perspective view of the exemplary truss setting bracket in FIG. 2 locked onto the member of the second truss.

FIG. 7 and FIG. 8 depict environmental and perspective views of the exemplary truss setting bracket 10 attached to the first truss T1 and being guided and locked onto the second truss T2. Several steps may be completed before lifting and guiding the truss setting bracket 10 attached to the first truss T1 and locking the truss setting bracket 10 to the desired location next to the second truss T2. Each truss may be assembled, or pre-fabricated, prior to arriving at the construction site, or may be assembled at the construction site. The first cradle 20 may slide over a member of a first truss T1 between the first finger 21 and the second finger 22, such that the first truss T1 may be substantially flush with the first surface 24*a*, the second surface 24*b*, and the third surface 24*c* of the first cradle surface 24. The first cradle 20 may be secured to the first truss T1 by the aperture 40. To secure the first cradle 20 to the first truss T1, a physical item may be inserted through the aperture 40 and coupled to the first truss T1, such that the first cradle 20 removably retains the first truss T1 by the aperture 40. Examples of the physical item that may be inserted through the aperture 40 include, but are not limited to, a nail, a rope, a pin, a latch, a screw, a spring loaded structure, and the like. The elongated catch guide 50 may be pivoted from the first position to the second position and coupled to the first foot 38 of the second cradle 30 by the coupling mechanism 51. In the second position, the elongated catch guide 50 may aide in maintaining the desired spacing between successive trusses. The first truss T1 may be lifted and guided towards the second truss T2 as the truss setting bracket 10 is guided towards the desired location next to the second truss T2.

By utilizing a crane C, the first truss T1 may be lifted and guided towards the second truss T2. A construction worker on the wall, roof, or support structure of a residential building, commercial building, etc. may guide the first truss T1, with the truss setting bracket 10 secured, towards the second truss T2. The construction worker may bump the elongated catch guide 50 along the second truss T2, such that the truss setting bracket 10 is guided towards the member of the second truss T2 while maintaining the desired spacing between the first truss T1 and the second truss T2. The first foot 38 and the second foot 39 may also aide the construction worker in guiding the second cradle 30 of the truss setting bracket 10 onto a member of the second truss T2. As the first truss T1 is guided toward the second truss T2 and the attached truss setting bracket 10 is guided towards the member of the second truss T2, the locking arm 60 begins to rotate counter-clockwise from the second position to the first position to removably retain the member of the second truss T2.

As the first truss T1 is lowered toward the second truss T2 and the attached truss setting bracket 10 is lowered toward the member of to the second truss T2, the locking arm 60 begins to move from the second position to the first position to retain the second truss T2. The locking arm 60 may be in the first position and abut against the second truss T2, such that the second truss T2 may not slip. The second cradle 30 may slide over the second truss T2 between the first finger 31 and the second finger 32, such that a portion of the second truss T2 may contact the first surface 34*a*, the second surface 34*b*, and/or the third surface 34*c* of the second cradle surface 34. The truss setting bracket 10 may keep the first truss T1 and the second truss T2 in place.

This method may be repeated utilizing at least one truss setting bracket 10, until a desired number of successive trusses are set for the framing. Once a truss is set, a plurality of structural support members may be installed atop the set trusses for further support. The plurality of structural support members may be plywood, oriented strand board, or any other material used in the art. As the plurality of structural support members are installed, the at least one truss setting bracket 10 may be removed. To remove the truss setting bracket 10, the aperture 40 is disengaged by removing the nail, rope, rod, etc. The locking arm 60 is disengaged by pressing a terminal end of the locking arm 60, such that the locking arm 60 rotates further counter-clockwise. Once the second cradle 30 is cleared, the locking arm 60 may automatically rotate clockwise about the springing mechanism 62 and return to the second position. The truss setting bracket 10 may be used to set subsequent trusses.

The aforementioned method may be performed in a matter of minutes and utilize fewer workers than any other methods known in the art. Additionally, utilizing the truss setting bracket 10 provides a more stable frame than any methods known in the art. Therefore, utilizing the exemplary truss setting bracket 10 in the method disclosed herein may save both time and money on construction projects, while minimizing potential safety hazards at a construction site.

The truss setting bracket 10 may be, but is not limited to being made of solid, lightweight, and/or rigid materials. In some embodiments, the truss setting bracket 10 may be made of solid aluminum. In other embodiments, the truss setting bracket 10 may be made of solid steel. In other embodiments, the truss setting bracket 10 may be made of hard wood. But most preferably, the truss setting bracket 10 is made of solid aluminum. In some embodiments, the truss setting bracket 10 may be coated with an oxide layer to prevent rust. The combination of aluminum coated with an oxide layer provides a lightweight, yet strong, durable body that may withstand a strong force without slipping. For example, if the truss setting bracket 10 is made of solid aluminum and the truss is set with the truss setting bracket 10, then the truss may be able to withstand a force up to 4,000 pounds without slipping. Therefore, the truss setting bracket 10 provides more strength and stabilization between successive trusses throughout the framing stage of construction.

Figure 9:
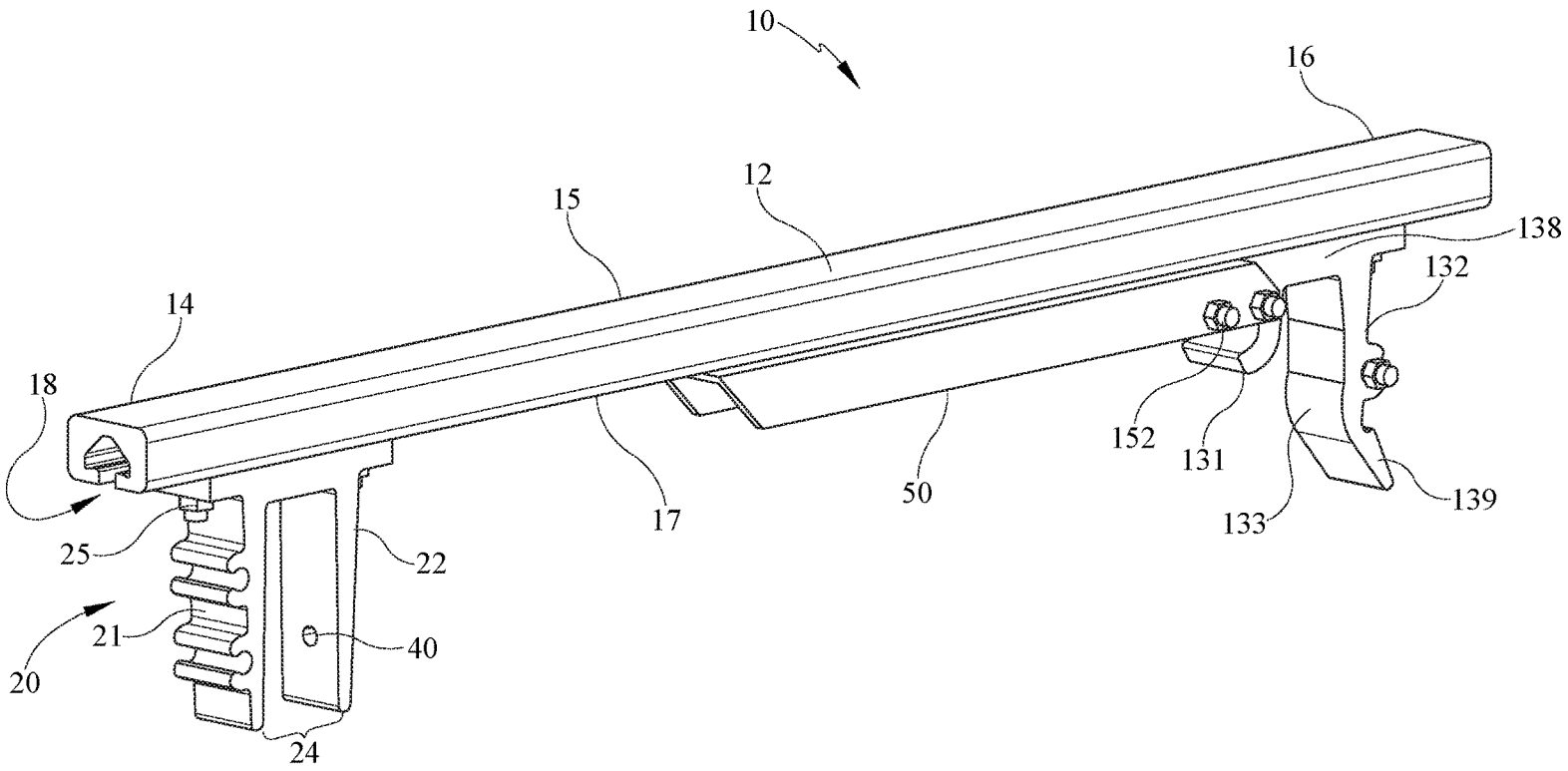
FIG. 9 is a perspective view of an exemplary truss setting bracket according to one embodiment herein.

Referring now to FIG. 9, a perspective view of an exemplary truss setting bracket 10 according to one embodiment herein is provided. The truss setting bracket 10 is depicted having an elongated body member 12, a first cradle 20, and a brace 138. The elongated body member 12 may be defined by a first end 14, a second end 16, a first side 15, a second side 17, an elongated body recess 18, and an axis of elongation A-A. The elongated body member 12 may take on various lengths depending on a desired spacing between successive trusses. Generally speaking, the elongated body member 12 can be in the range of approximately one foot long to approximately ten feet long, but most preferably would be in the range of approximately two feet long to four feet long. The first cradle 20 may be located at the first end 14 of the elongated body member 12 and depend downwardly from the second side 17. The brace 138 may be located at the second end 16 of the elongated body member 12 and depend downwardly from the second side 17.

The first cradle 20 and the brace 138 are removably retainable within the elongated body recess 18 by locking mechanism 25, 35, respectively, and slidable along the axis of elongation A-A. Markings indicating interval measurements may be disposed proximate the first cradle 20 and the brace 138 such that the distance between the first cradle 20 and the brace 138 may be adjusted. If, for example, the elongated body member 12 is three feet long, then the distance between the first cradle 20 and the brace 138 may be adjusted to two feet to achieve a two-foot spacing by sliding each of the first cradle 20 and the brace 138 within the elongated body recess 18. For example, if the desired spacing between successive trusses is five feet, then the truss setting bracket 10 may have an elongated body member 12 that is, for example, six feet long and each of the first cradle 20 and the brace 138 may be located approximately six inches toward the center of the elongated body member 12 from the first end 14 and the second end 16. Each of the first cradle 20 and the brace 138 may then be secured in place using each respective locking mechanism 25, 35.

The first cradle 20 may further include a first finger 21 and a second finger 22. An aperture 40 may be disposed on either the first finger 21, the second finger 22, or both, but is depicted as being disposed on the second finger 22 in FIG. 9. The arrangement of the first finger 21 and the second finger 22 creates the first cradle surface 24 disposed therebetween. The first cradle surface 24 may be substantially U-shaped and may include the first surface 24*a* generally perpendicular to the elongated body member 12, the second surface 24*b* generally perpendicular to the elongated body member 12, and the third surface 24*c* generally parallel to the elongated body member 12 (FIG. 3).

The brace 138 may further include a leg 132 and a first ramp 131, each depending therefrom. The leg 132 may further include a second ramp 139 and a leg surface 133. The second ramp 139 may be disposed at terminal end of the leg 132. The first ramp 131 may be located between the first cradle 20 and the leg 132. Further, the first ramp 131 may include a coupling mechanism. In some embodiments, the coupling mechanism may be a separate element connected to a terminal end of the first ramp 131, such as a magnet, a recess, a foot (FIG. 4), or the like. In other implementations, and as depicted, the coupling mechanism may be the first ramp 131. Further, an elongated catch guide 50 may be pivotally connected to the first ramp 131, such that the elongated catch guide 50 is pivotable between a first position and a second position. In the first position, the elongated catch guide 50 may abut the second side 17 of the elongated body member 12 and be substantially parallel thereto. In the second position, the elongated catch guide 50 may be substantially perpendicular to the elongated body member 12.

In FIG. 9, the elongated catch guide 50 is depicted in the first position and pivotally connected to the first ramp 131. The elongated catch guide 50 may further include a locking mechanism 152 that may be removable. The locking mechanism 152 may be, but is not limited to, a physical item positively retaining the elongated catch guide 50 in the second position. Examples include a pin, a spring-loaded mechanism, a rod, a screw, a nut, a bolt, a ramp, a cam, and the like. Interaction between the coupling mechanism of the first ramp 131 and the locking mechanism 152 of the elongated catch guide 50 will be discussed hereinafter with respect to FIG. 11.

Figure 10:
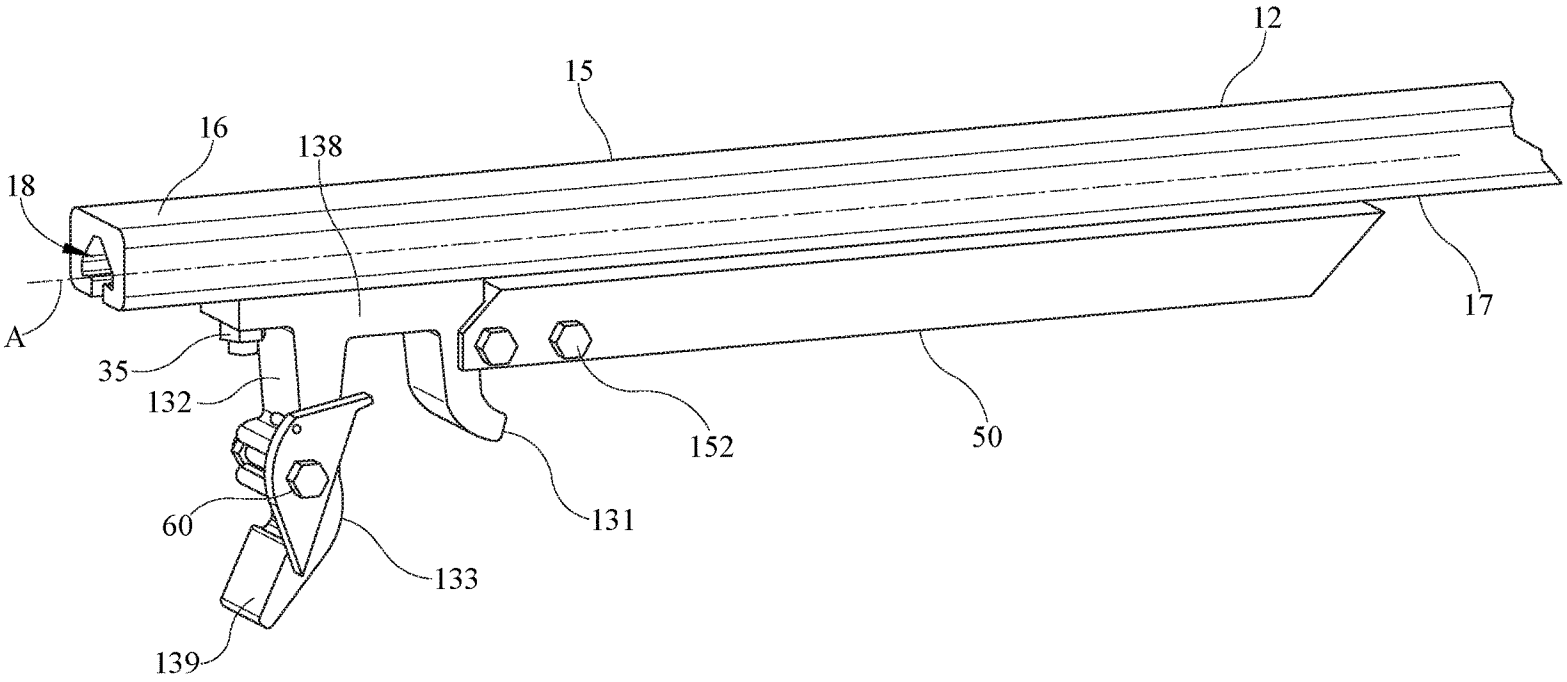
FIG. 10 is a perspective view of a second end of the exemplary truss setting bracket in FIG. 9.

Referring now to FIG. 10, a perspective view of a second end 16 of the truss setting bracket 10 in FIG. 9 is provided. If the brace 138 is at a desired position along the axis of elongation A-A, then the locking mechanism 35 may be tightened, engaged, etc. If the brace 138 is not at the desired position along the axis of elongation A-A, then the locking mechanism may be loosened, disengaged, etc. and the brace 138 may slide along the axis of elongation A-A within the elongated body recess 18, until the desired position is achieved. The locking mechanism 35 may be, but is not limited to, a physical item positively retaining the brace 138 at the desired position. Examples include, but are not limited to, a bolt and a nut, a pin, a latch, a screw, a nut, a rod, a spring-loaded structure, a magnet, and the like.

The leg 132 may further include a locking arm 60 to removably retain a member of a truss. The locking arm 60 may be connected to the leg 132 by a removable locking mechanism. The locking arm 60 is pivotable between at least a first position and a second position. In the first position, the locking arm 60 may removably retain a portion of the member of the truss, and in the second position, the locking arm 60 may release the portion of the member of the truss. In the depicted embodiment of FIG. 10, the elongated catch guide 50 is in the first position and the locking arm 60 is in the second position. The arrangement is favorable for storing the truss setting bracket 10.

Figure 11:
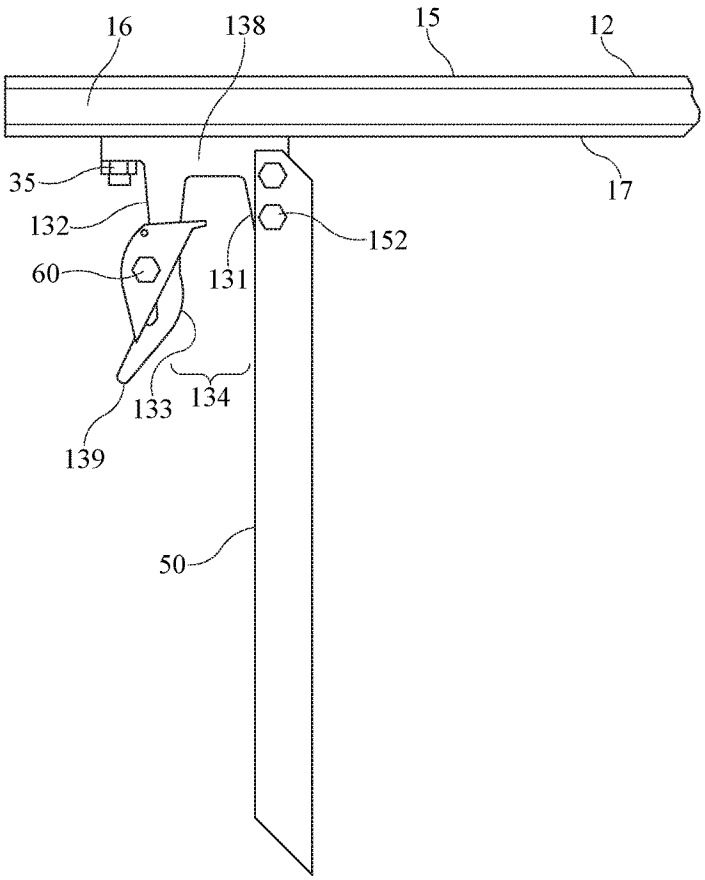
FIG. 11 is a side view of the second end of the exemplary truss setting bracket in FIG. 10.

Referring now to FIG. 11, a side view of the second end 16 of the truss setting bracket 10 in FIG. 10 is provided. The elongated catch guide 50 is in the second position and may be removably retained by the coupling mechanism of the first ramp 131. To removably retain the elongated catch guide 50 in the second position, the locking mechanism 152 of the elongated catch guide 50 may be disengaged, the elongated catch guide 50 may be pivoted about the first ramp 131 from the first position to the second position about a rotational axis defined by the leg 132 and be substantially perpendicular to the elongated body member 12, and the locking mechanism 152 may be engaged about the coupling mechanism of the first ramp 131. For example, if the locking mechanism 152 is a nut and a bolt, then the nut and the bolt may be disengaged from the elongated catch guide 50 in the first position, the elongated catch guide 50 may be pivoted to the second position, and then engaged about the coupling mechanism of the first ramp 131. As another example, if the locking mechanism 152 is a latch, then the latch may be disengaged from the elongated catch guide 50 in the first position, the elongated catch guide 50 may be pivoted to the second position, and then engaged about the coupling mechanism of the first ramp 131. As yet another example, if the locking mechanism 152 is a magnet, then the elongated catch guide may be pivoted to the second position, and then engaged about the coupling mechanism of the first ramp 131 via another magnet of the opposite polarity of the magnet of the locking mechanism 152.

Further, in the second position, the elongated catch guide 50 and the leg surface 133 may create a channel 134 for receiving a portion of a member of a truss. The channel 134 may be substantially U-shaped and may exist when the elongated catch guide 50 is in the second position. Even further, in the second position, the elongated catch guide 50 may aide in maintaining a desired amount of spacing between successive trusses. For example, if the truss setting bracket 10 is secured to a first truss T1 and the first truss T1 is lifted and guided towards a member of a second truss T2, then the first truss T1 may lowered towards the second truss T2. The brace 138 may receive the member of the second truss T2 by the channel 134, such that the member of the second truss T2 may be substantially flush with the leg surface 133 of the brace 138 and the elongated catch guide 50.

A method for setting a truss using the truss setting bracket 10 is also provided. Several steps may be completed before lifting and guiding the truss setting bracket 10 attached to the first truss T1 and locking the truss setting bracket 10 to a desired location next to the second truss T2. Each truss may be assembled, or pre-fabricated, prior to arriving at the construction site, or may be assembled at the construction site. The first cradle 20 may slide over a member of a first truss T1 between the first finger 21 and the second finger 22, such that the first truss T1 may be substantially flush with the first surface 24*a*, the second surface 24*b*, and the third surface 24*c* of the first cradle surface 24 (FIG. 7 and FIG. 8). The first cradle 20 may be secured to the first truss T1 by the aperture 40. To secure the first cradle 20 to the first truss T1, a physical item may be inserted through the aperture 40 and coupled to the first truss T1, such that the first cradle 20 removably retains the first truss T1 by the aperture 40. Examples of the physical item that may be inserted through the aperture 40 include, but are not limited to, a nail, a rope, a pin, a latch, a screw, a spring loaded structure, and the like. The elongated catch guide 50 may be pivoted from the first position to the second position and the locking mechanism 152 may be engaged about the coupling mechanism of the first ramp 131 of the brace 138. Pivoting the elongated catch guide 50 from the first position to the second position creates the channel 134 by way of the leg surface 133 and the elongated catch guide 50 being in the second position. The first truss T1 may be lifted and guided towards the second truss T2 as the truss setting bracket 10 is guided towards the desired location next to the second truss T2.

By utilizing a crane C, the first truss T1 may be lifted and guided towards the second truss T2. A construction worker on the wall, roof, or support structure of a residential building, commercial building, etc. may guide the first truss T1, with the truss setting bracket 10 secured, towards the second truss T2. The construction worker may bump the elongated catch guide 50 along the second truss T2, such that the truss setting bracket 10 is guided towards the member of the second truss T2 while maintaining the desired spacing between the first truss T1 and the second truss T2. The second ramp 139 may also aide the construction worker in guiding the channel 134 of the truss setting bracket 10 onto a member of the second truss T2, such that the brace 138 receives the member of the second truss T2. As the first truss T1 is guided toward the second truss T2 and the attached truss setting bracket 10 is guided towards the member of the second truss T2, the locking arm 60 begins to rotate counter-clockwise from the second position to the first position to removably retain the member of the second truss T2.

As the first truss T1 is lowered toward the second truss T2 and the attached truss setting bracket 10 is lowered toward the member of to the second truss T2, the locking arm 60 begins to move from the second position to the first position to retain the second truss T2. The locking arm 60 may be in the first position and abut against the second truss T2, such that the second truss T2 may not slip. The brace 138 may receive the member of the second truss T2 by way of the channel 134, such that a portion of the second truss T2 may contact the leg surface 133 and the elongated catch guide 50. The truss setting bracket 10 may keep the first truss T1 and the second truss T2 in place.

This method may be repeated utilizing at least one truss setting bracket 10, until a desired number of successive trusses are set for the framing. Once a truss is set, a plurality of structural support members may be installed atop the set trusses for further support. The plurality of structural support members may be plywood, oriented strand board, or any other material used in the art. As the plurality of structural support members are installed, the at least one truss setting bracket 10 may be removed. To remove the truss setting bracket 10, the aperture 40 is disengaged by removing the nail, rope, rod, etc. The locking arm 60 is disengaged by pressing a terminal end of the locking arm 60, such that the locking arm 60 rotates further counter-clockwise. Once the brace 138 is cleared, the locking arm 60 may automatically rotate clockwise and return to the second position. The truss setting bracket 10 may be used to set subsequent trusses. For example, once a truss is set, a plurality of structural support members may be installed atop the set trusses for further support and the truss setting bracket 10 may be removed and used on each successive truss to be set. As another example, a plurality of truss setting brackets 10 may be provided, each successive truss may set, and then the plurality of structural support members may be installed atop the set trusses after each successive truss is set. In this example, the number of truss setting brackets 10 may depend on the number of trusses to be set.

The truss setting bracket 10 may be, but is not limited to being made of solid, lightweight, and/or rigid materials including, for example, metal, metal alloys, plastics, wood, composite materials, and the like. In some embodiments, the truss setting bracket 10 may be made of solid aluminum. In other embodiments, the truss setting bracket 10 may be made of solid steel. But most preferably, the truss setting bracket 10 is made of solid aluminum. In some embodiments, the truss setting bracket 10 may be coated with an oxide layer to prevent rust. The combination of aluminum coated with an oxide layer provides a lightweight, yet strong, durable body that may withstand a strong force without slipping. For example, if the truss setting bracket 10 is made of solid aluminum and the truss is set with the truss setting bracket 10, then the truss may be able to withstand a force up to 4,000 pounds without slipping. Therefore, the truss setting bracket 10 provides more strength and stabilization between successive trusses throughout the framing stage of construction.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

It should also be understood that, unless clearly indicated to the contrary, in any methods claimed herein that include more than one step or act, the order of the steps or acts of the method is not necessarily limited to the order in which the steps or acts of the method are recited.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B," when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least of A and B" (or, equivalently, "at least one of A or B," or equivalently, "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively as set forth in the United States Patent Office Manual of Patent Examining Procedures, Section 2111.03.

The foregoing description of several methods and embodiments have been presented for purposes of illustration. It is intended to be exhaustive or to limit the precise steps and/or forms disclosed, and obviously many modifications and variations are possible in light of the above teaching. It is intended that the scope and all equivalents be defined by the claims appended hereto.

What is claimed is:

1. A truss setting bracket, comprising:

an elongated body member having a first end, a second end, a first side, a second side, and an axis of elongation;

a first cradle located at said first end of said elongated body member and depending downwardly from said second side, wherein said first cradle has a first finger and a second finger creating a first cradle surface disposed between said first finger and said second finger;

a brace located at said second end of said elongated body member and depending downwardly from said second side, said brace having a leg and a first ramp, said first ramp located between said first cradle and said leg, wherein said leg further comprises a second ramp at a terminal end thereof and a leg surface;

an elongated catch guide pivotally connected to said first ramp for guiding said truss setting bracket toward a member of a truss, wherein said elongated catch guide is pivotable between at least a first position and a second position; and a locking arm connected to said leg, wherein said locking arm removably retains the member of the truss.

2. The truss setting bracket of claim 1, further comprising an aperture disposed on at least one of said first finger or said second finger of said first cradle.

3. The truss setting bracket of claim 1, further comprising an elongated body recess disposed parallel to said axis of elongation.

4. The truss setting bracket of claim 3, wherein said first cradle and said brace are retainable within said elongated body recess.

5. The truss setting bracket of claim 1, wherein said first cradle and said brace are slidable along said axis of elongation.

6. The truss setting bracket of claim 5, wherein each of said first cradle and said brace has a locking mechanism for releasably locking each of said first cradle and said brace at multiple locations along said axis of elongation.

7. The truss setting bracket of claim 1, wherein said elongated body member further comprises markings indicating interval measurements along said elongated body member.

8. The truss setting bracket of claim 1, wherein in said first position, said elongated catch guide is substantially parallel to said elongated body member.

9. The truss setting bracket of claim 1, wherein in said second position, said elongated catch guide is substantially perpendicular to said elongated body member.

10. The truss setting bracket of claim 9, wherein said elongated catch guide and said leg surface of said brace create a channel for receiving a portion of the member of the truss.

11. The truss setting bracket of claim 10, wherein said first cradle surface and said channel are substantially U-shaped.

12. The truss setting bracket of claim 11, wherein said first cradle surface is defined by a first surface generally perpendicular to said elongated body member, a second surface generally perpendicular to said elongated body member, and a third surface generally parallel to said elongated body member.

13. The truss setting bracket of claim 1, wherein said locking arm is connected to said leg by a removable locking mechanism.

14. The truss setting bracket of claim 13, wherein said locking arm is pivotable between at least a first position and a second position.

15. The truss setting bracket of claim 14, wherein in said first position, said locking arm removably retains a portion of the member of the truss and in said second position said locking arm releases the portion of the member of the truss.

16. The truss setting bracket of claim 1, wherein said first ramp includes a coupling mechanism and said elongated catch guide includes a locking mechanism, and wherein in said second position, said locking mechanism of said elongated catch guide is removably retained by said coupling mechanism of said first ramp.

17. A truss setting bracket, comprising:

an elongated body member having a first end, a second end, a first side, and a second side;

said first end having:

a first cradle depending downwardly from said second side, said first cradle slidable over a member of a first truss; and said second end having:

a brace depending downwardly from said second side, said brace having a leg and a first ramp, wherein said leg further comprises a second ramp at a terminal end thereof and a leg surface, an elongated catch guide pivotally connected to said first ramp for guiding said truss setting bracket toward a member of a second truss, said elongated catch guide is pivotable between at least a first position and a second position, and a locking arm connected to said leg, wherein said locking arm removably retains the member of the second truss.

18. The truss setting bracket of claim 17, wherein in said second position, said elongated catch guide and said leg surface create a channel for receiving the member of the second truss.

19. A method for setting a truss comprising:

providing a truss setting bracket having a first cradle, a brace having a leg and a leg surface, an elongated catch guide, and a locking arm;

sliding said first cradle of said truss setting bracket over a member of a first truss;

securing said first cradle of said truss setting bracket to the member of the first truss;

pivoting said elongated catch guide of said truss setting bracket from a first position to a second position to create a channel;

lifting the first truss toward a second truss;

guiding said elongated catch guide of said truss setting bracket into engagement with a member of the second truss, such that said brace of said truss setting bracket receives the member of the second truss; and securing said truss setting bracket onto the member of the second truss such that said locking arm of said truss setting bracket removably retains said truss setting bracket on the second truss.

20. The method of claim 19, wherein the method further comprises:

installing a plurality of structural support members; and removing said truss setting bracket.

* * * * *